US011058595B1

(12) United States Patent
Chiu

(10) Patent No.: US 11,058,595 B1
(45) Date of Patent: Jul. 13, 2021

(54) HEALTHCARE LIFTING VEHICLE

(71) Applicant: TIMOTION TECHNOLOGY CO., LTD., New Taipei (TW)

(72) Inventor: Yi-Chien Chiu, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/814,993

(22) Filed: Mar. 11, 2020

(30) Foreign Application Priority Data

Jan. 9, 2020 (TW) ..... 109200372

(51) Int. Cl.
*A61G 7/10* (2006.01)

(52) U.S. Cl.
CPC ..... *A61G 7/1051* (2013.01); *A61G 7/1015* (2013.01); *A61G 7/1069* (2013.01); *A61G 7/1073* (2013.01); *A61G 2203/20* (2013.01)

(58) Field of Classification Search
CPC .. A61G 7/1051; A61G 7/1015; A61G 7/1069; A61G 7/1073; A61G 2203/20
USPC ..... 74/355
See application file for complete search history.

(56) References Cited

U.S. PATENT DOCUMENTS 5,456,655 A 10/1995 Morris
5,694,654 A * 12/1997 Roy ..... A61G 7/1015 5/83.1
7,065,811 B2 * 6/2006 Newkirk ..... A61M 5/1415 5/600
7,725,964 B2 * 6/2010 Minning ..... A61G 7/0533 5/81.1 R
7,865,983 B2 * 1/2011 Newkirk ..... A61G 13/107 5/503.1
8,613,715 B2 * 12/2013 Wright ..... A61H 1/02 601/5
9,629,769 B2 * 4/2017 Newkirk ..... A61G 7/1034
10,010,468 B2 * 7/2018 Duquette ..... D07B 5/006
10,561,555 B2 * 2/2020 Kaikenger ..... A61G 7/1044
2010/0064432 A1 3/2010 Duquette et al.
2013/0019401 A1 1/2013 Faucher et al.

* cited by examiner

*Primary Examiner* — Ha Dinh Ho
(74) *Attorney, Agent, or Firm* — Chun-Ming Shih; HDLS IPR Services

(57) ABSTRACT

A healthcare lifting vehicle includes a base frame, a drive mechanism, a preloading mechanism and a conveying mechanism. The preloading mechanism includes a pressure wheel and an elastic member, and the pressure wheel is movably coupled to the base frame, and both ends of the elastic member are connected to the base frame and the pressure wheel respectively. The conveying mechanism includes a reel, a transfer gear and a conveyor belt, and the reel is pivotally connected to the base frame and driven by the drive mechanism, and the transfer gear is axially coupled to base frame and formed on a side of the pressure wheel, and the conveyor belt is wound around the reel and extended towards the transfer gear and elastically coupled between the transfer gear and the pressure wheel.

16 Claims, 10 Drawing Sheets

HEALTHCARE LIFTING VEHICLE

BACKGROUND OF THE INVENTION

1. Technical Field

The technical field relates to lifting vehicles, and more particularly to a healthcare lifting vehicle.

2. Description of Related Art

Disabled persons and patients are moved between their bed and wheelchair repeatedly and frequently, and caregivers require lots of physical strength to do their work. Therefore, related manufacturers have developed various healthcare lifting vehicles to assist the caregivers.

In a conventional lifting vehicle as disclosed in U.S. Pat. Publication No. US20130019401A1, the lifting vehicle is provided for transporting patients, and the lifting vehicle comprises a lifting element, and an integral flexible load-bearing support member retractable into the lifting element, and integrated load-bearing, data communication, and power components for transmitting data and/or power to the lifting element.

In a conventional support member of a patient lifting device as disclosed in U.S. Pat. Publication No. US20100064432A1, the support member comprises a lifting strap having an internal core and external plastic layer, and the lifting strap is fixed to a patient's lifting device by guiding a spool element of the lifting strap to compress the lifting strap and a belt clip assembly in place.

In a conventional ambulatory support system for patients as disclosed in U.S. Pat. No. 5,456,655, the support system comprises an overhead system which allows a support carrier to travel within its confines, so that it may be located above a patient at any time, and the system further supplies a passive fall interruption device for preventing patients from falling accidentally.

Although the conventional lifting vehicles can be used for transporting the patients, their actual use still has the following problems. Some of the lifting vehicles with a poor structural design may cause the conveyor belt to be curled and tangled during the conveyor belt retraction process and result in a failure of retraction. Some other lifting vehicles with a very large and heavy hanging device or a heavy hook, the hook keeps the conveyor belt in tension and often hits and injuries the patient or the caregiver.

In view of the aforementioned drawbacks of the prior art, the discloser of this disclosure based on years of experience in the related industry to conduct extensive research and experiment, and finally provided a feasible solution as disclosed in this disclosure to overcome the drawbacks of the prior art.

SUMMARY OF THE INVENTION

Therefore, it is a primary object of this disclosure to provide a healthcare lifting vehicle with a lightweight hook design and capable of maintaining a tight status between a reel and a transfer gear.

To achieve the aforementioned and other objectives, this disclosure provides a healthcare lifting vehicle, for hanging a load, comprising a base frame, a drive mechanism, a preloading mechanism and a conveying mechanism, wherein the drive mechanism is fixed onto the base frame; the preloading mechanism comprises a pressure wheel and an elastic member, and the pressure wheel is movably coupled to the base frame, and the elastic member has an end coupled to the pressure wheel; the conveying mechanism comprises a reel, a transfer gear and a conveyor belt, and the reel is pivotally coupled to the base frame and driven by the drive mechanism to rotate, and the transfer gear is axially coupled to the base frame and formed on a side of the pressure wheel, and the conveyor belt is wound around the reel, extended in a direction towards the transfer gear, and elastically clamped between the transfer gear and the pressure wheel; wherein when the conveyor belt carries the load to move, the pressure wheel is pushed by the conveyor belt in a direction away from the transfer gear, and when the conveyor belt does not carry the load to move, the pressure wheel is acted by the elastic member and operated with the transfer gear jointly to clamp the conveyor belt.

This disclosure has the following effects. The driven wheel and the one-way rotary wheel are detachably coupled to each other, so that the conveyor belt situated between the reel and the transfer gear is maintained at a tight state. By the design of the guide mechanism, when the conveyor belt is rewound to rise and the hook will reach the position of the overbelt member, the overbelt member is pushed to move upward and touch the micro switch, so as to achieve an anti-collision mechanism. With the installation of the overload protection unit, when the load exceeds a rated weight, the control unit will stop the operation of the drive mechanism. By using the position sensing unit together with the color strip of the conveyor belt, the conveyor belt can be controlled and sent to a limit position effectively. By the installation of the emergency power supply unit, a primary electrical power still can be supplied to the drive mechanism during power failure, so as to allow the load to descend to a low position.

DESCRIPTION OF THE PREFERRED EMBODIMENTS

Figure 1:
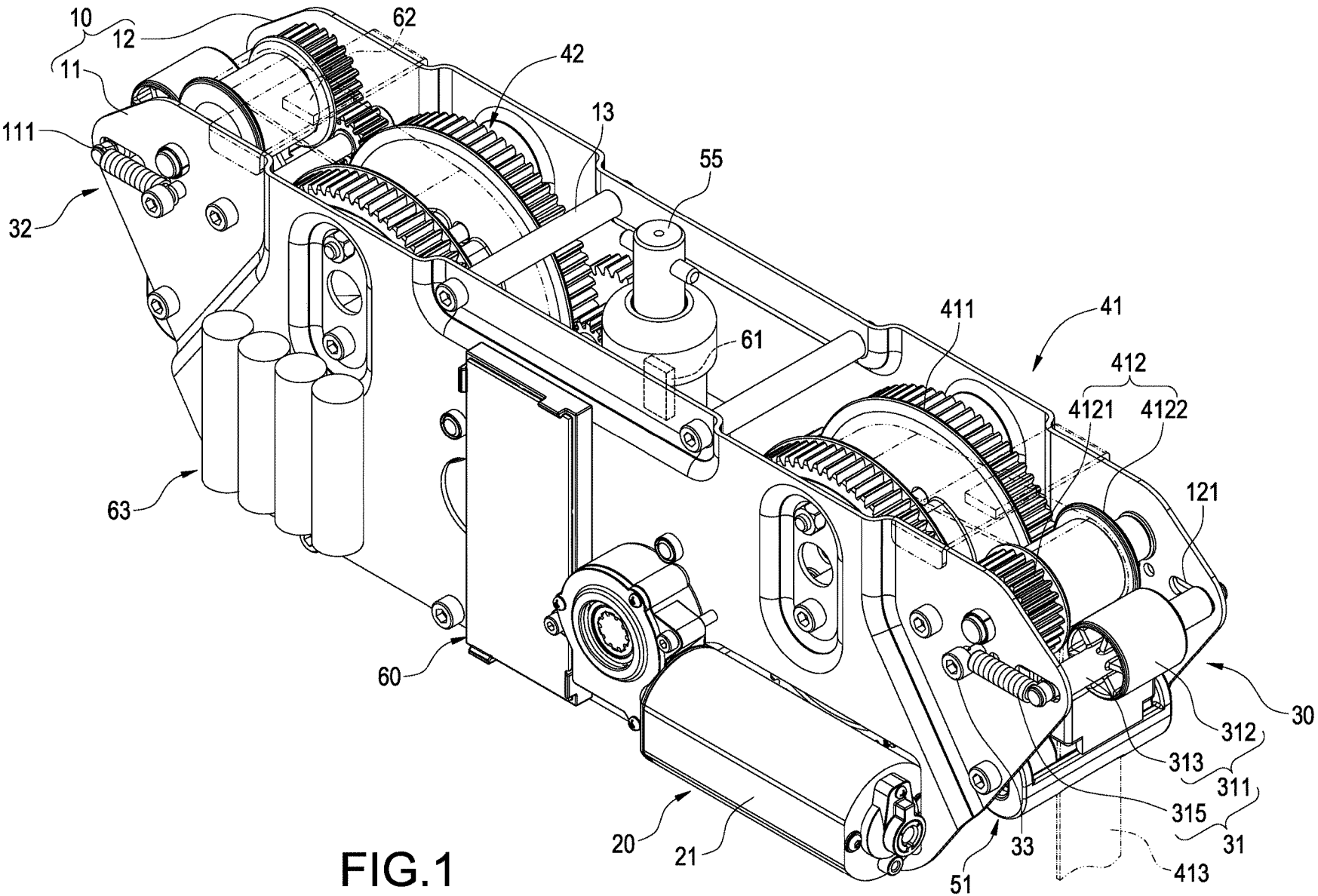
FIG. 1 is a schematic view of a healthcare lifting vehicle of this disclosure.
Figure 2:
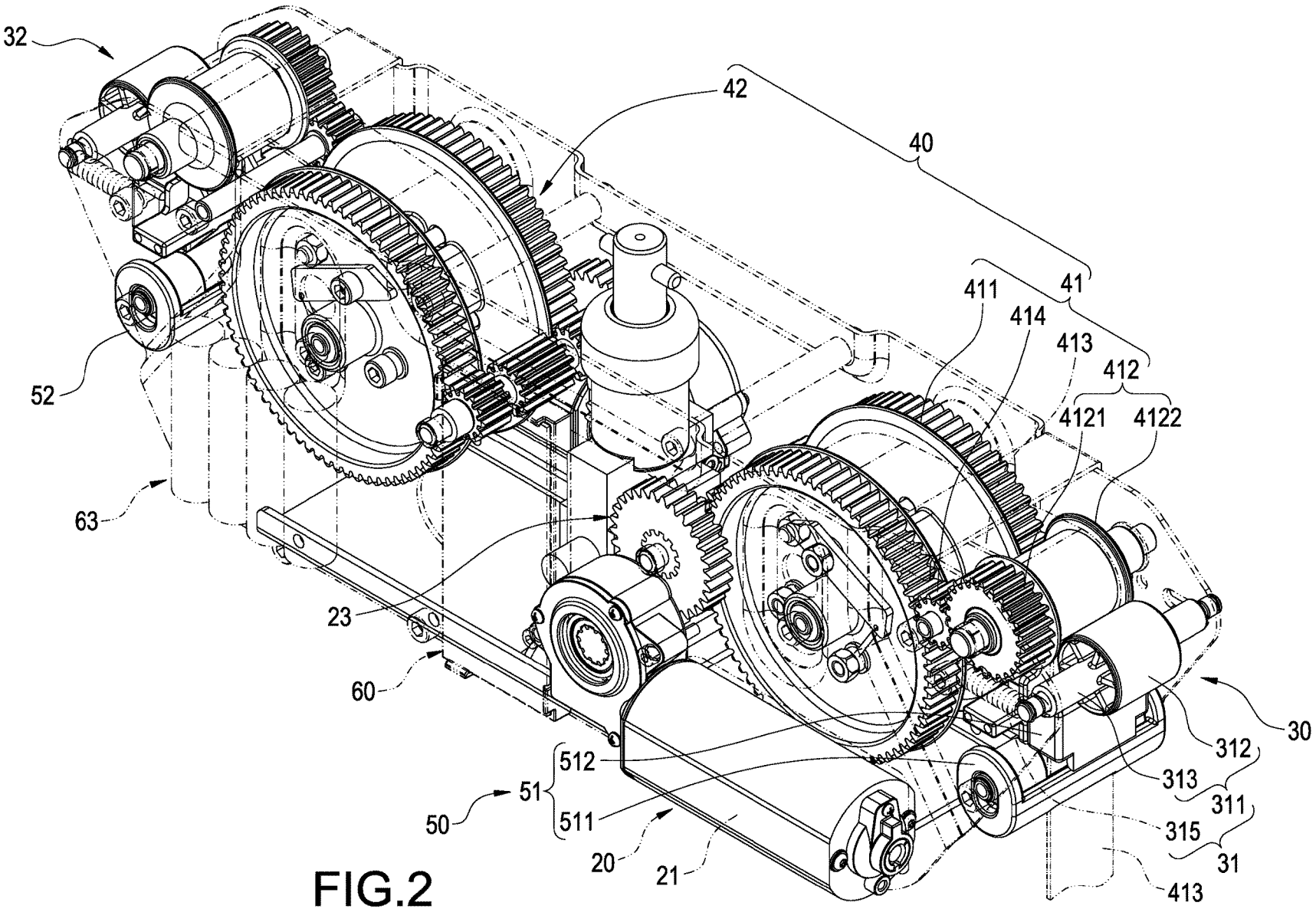
FIG. 2 is a perspective view of the healthcare lifting vehicle of this disclosure.

The technical contents of this disclosure will become apparent with the detailed description of preferred embodiments accompanied with the illustration of related drawings as follows. It is intended that the embodiments and drawings disclosed herein are to be considered illustrative rather than restrictive.

With reference to FIGS. 1 to 4 and 7 for a healthcare lifting vehicle of this disclosure, the healthcare lifting vehicle comprises a base frame 10, a drive mechanism 20, a preloading mechanism 30 and a conveying mechanism 40.

The base frame 10 comprises a front plate 11, a rear plate 12, a plurality of connecting rods 13 and a bottom plate 14, wherein the front plate 11 and rear plate 12 are substantially in the same shape, and they are spaced from each other and coupled to each other by the connecting rod 13, and the bottom plate 14 is coupled to the bottom of the front plate 11 and the bottom of the rear plate 12, and a strip groove 111, 121 is formed separately at two side positions of the front plate 11 and the rear plate 12 and configured to be corresponsive to each other.

In this embodiment, the drive mechanism 20 comprises a first motor 21 and a second motor 22, and the first motor 21 is fixed to a lower part of the right side of the front plate 11 and driven by a reduction gear set 23, and the reduction gear set 23 is axially coupled between the front plate 11 and the rear plate 12.

Further, the second motor 22 is fixed to a lower part of the left side of the rear plate 12, wherein the first motor 21 and the second motor 22 are electrically coupled to a control unit 60 to achieve a synchronous operation. Since the components of the second motor 22 are the same as those of the first motor 21 are they are driven by a reduction gear set 23, therefore the detailed description of the second motor 22 will not be repeated.

Figure 3:
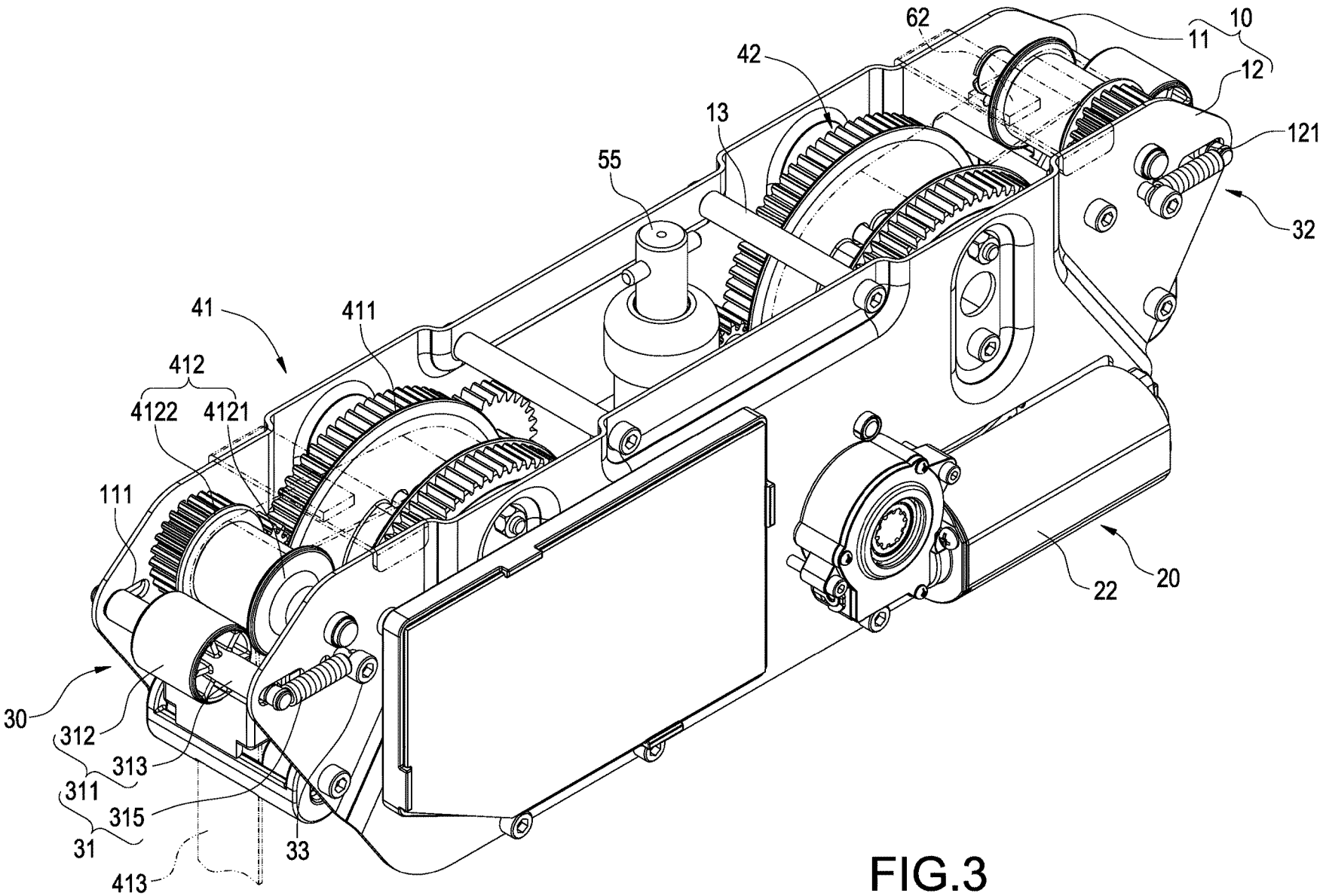
FIG. 3 is another perspective view of the healthcare lifting vehicle of this disclosure.

In this embodiment, the preloading mechanism 30 comprises a first preloading mechanism 31 and a second preloading mechanism 32, and the first preloading mechanism 31 comprises a pressure wheel 311 and an elastic member 315, and the pressure wheel 311 comprises a roller 312 and a shaft 313, and the shaft 313 is extended from the center of the roller 312 to both sides and movably coupled into the strip groove 111, 121. In this embodiment, the elastic member 315 is a tension spring, but this embodiment is not limited to such arrangement only. The elastic member 315 comes with a quantity of two, and one of the elastic members 315 has an end coupled to an end of the shaft 313 and the other end fixed onto the front plate 11 by a screw 33, and the elastic member 315 is formed on an outer side of the front plate 11. The other elastic member 315 has an end fixed onto the rear plate 12 by a screw 33 and the other end coupled to an end of the shaft 313, and the elastic member 315 is formed on an outer side of the rear plate 12 (as shown in FIG. 3).

Since the components of the second preloading mechanism 32 are the same as those of the first preloading mechanism 31, and the connection and effect of the second preloading mechanism 32 with the base frame 10 and the screw 33 are substantially the same as those of the first preloading mechanism 31, their description will be repeated.

In this embodiment, the conveying mechanism 40 comprises a first conveying mechanism 41, a second conveying mechanism 42, and two hooks 43, and the first conveying mechanism 41 comprises a reel 411, a transfer gear 412, and a conveyor belt 413, and the reel 411 is pivotally coupled between the front plate 11 and the rear plate 12 and driven by the first motor 21 and the reduction gear set 23 to rotate, and the transfer gear 412 is axially coupled between the front plate 11 and the rear plate 12 and formed on a side of the pressure wheel 311, and the reel 411 drives the transfer gear 412 through an idler gear 414 to maintain the same rotation direction of the reel 411 and the transfer gear 412. The conveyor belt 413 is wound around the reel 411, extended in a direction towards the transfer gear 412 and the pressure wheel 311, and elastically clamped between the transfer gear 412 and the pressure wheel 311, and an end of the conveyor belt 413 away from the reel 411 is coupled to the hook 43, wherein the hook 43 is made of a lightweight metal (such as aluminum, magnesium, or their alloys) or a plastic material (such as P.O.M or PC, etc.)

In this embodiment, the transfer gear 412 comprises a driven wheel 4121 and a one-way rotary wheel 4122 detachably coupled to the driven wheel 4121, wherein the one-way rotary wheel 4122 can just rotate in a single direction only. In other words, when the reel 411 is driven by the drive mechanism 20 to rotate clockwise (for releasing), the reel 411 drives the driven wheel 4121 and the one-way rotary wheel 4122 to rotate altogether through the idler gear 414. On the other hand, when the reel 411 is driven by the drive mechanism 20 to rotate counterclockwise (for rewinding), the reel 411 drives the driven wheel 4121 to rotate through the idler gear 414. Now, the driven wheel 4121 and the one-way rotary wheel 4122 are detached from each other, so that the conveyor belt 413 situated between the reel 411 and the transfer gear 412 maintains a tight state.

Since the components of the second conveying mechanism 42 are the same as those of the first conveying mechanism 41, and the connection and transmission with the drive mechanism 20 of the second conveying mechanism 42 are the same as those of the first conveying mechanism 41, therefore their description will not be repeated.

Figure 5:
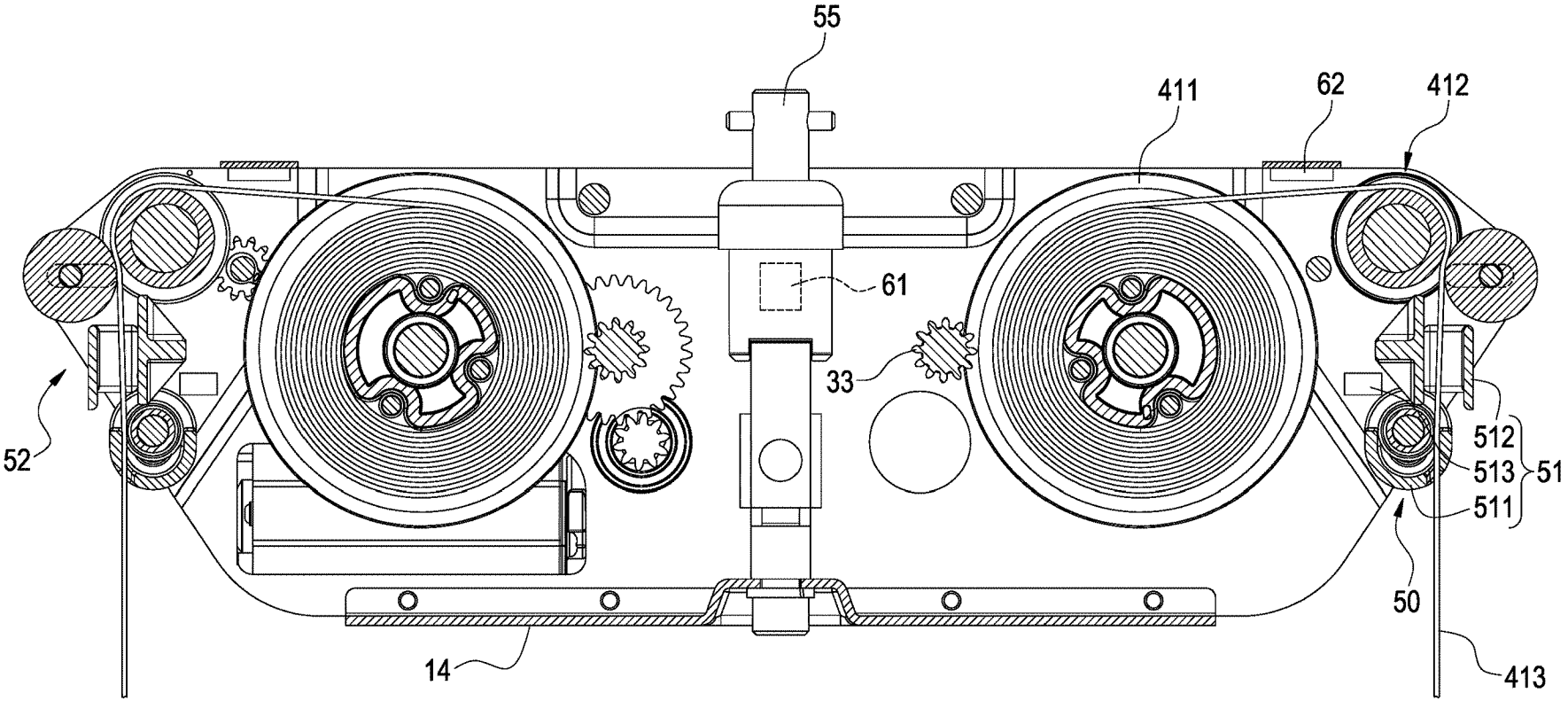
FIG. 5 is a first cross-sectional view showing a using status of the healthcare lifting vehicle of this disclosure.
Figure 7:
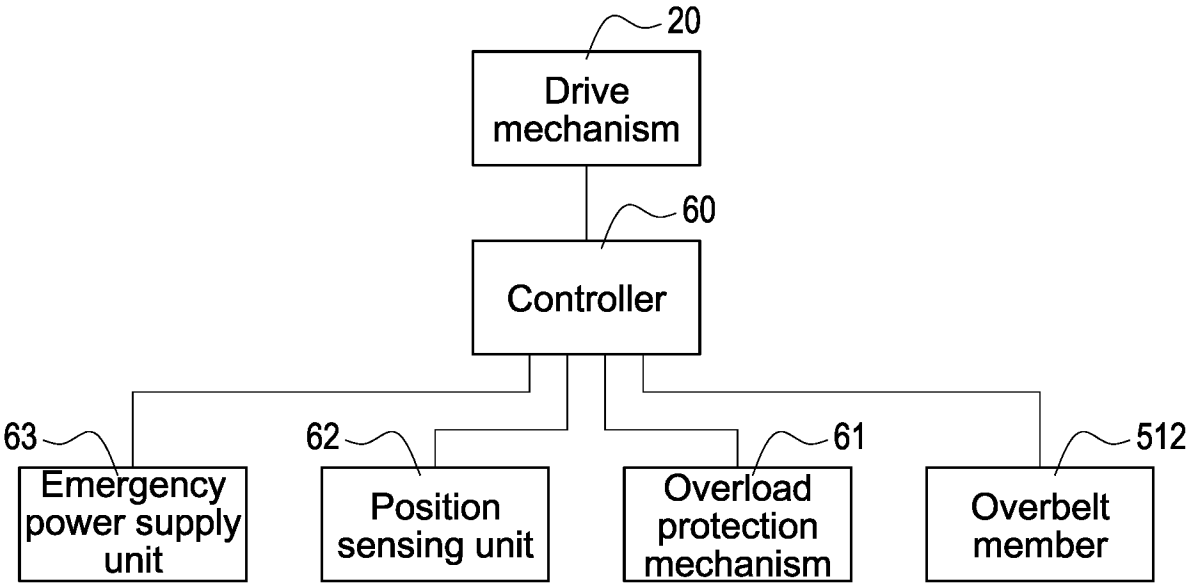
FIG. 7 is a block diagram of the healthcare lifting vehicle of this disclosure.

The healthcare lifting vehicle of this disclosure further comprises a guide mechanism 50 installed between the front plate 11 and the rear plate 12 and formed at a lower position of the transfer gear 412 and the pressure wheel 311. The guide mechanism 50 comprises a first guide assembly 51 and a second guide assembly 52, and the first guide assembly 51 comprises a belt guide seat 511, an overbelt member 512 and a micro switch 513 (as shown in FIG. 5), and the belt guide seat 511 is movably coupled between the front plate 11 and a rear plate 12 by a bolt, and the overbelt member 512 is mounted onto the top of the belt guide seat 511, and the micro switch 513 is fixed to the base frame 10 by a screw and formed at the top of the belt guide seat 511, and the belt guide seat 511 and the overbelt member 512 are provided for passing and installing the conveyor belt 413. When the conveyor belt 413 is wound by the reel 411 to ascend and the hook 43 reaches the position of the belt guide seat 511, the hook 43 will push the belt guide seat 511 to move upward, and after the belt guide seat 511 touches the micro switch 513, the micro switch 513 sends an electrical signal to the controller 60 (as shown in FIG. 7), and then the controller 60 drives the drive mechanism 20 to stop its operation, so as to achieve an anti-collision mechanism.

Since the components of the second guide assembly 52 are the same as those of the first guide assembly 51, and the connection and transmission of the second guide assembly 52 with the base frame 10, the preloading mechanism 30 and the conveying mechanism 40 are the same as those of the first guide assembly 51, therefore their description will not be repeated.

The healthcare lifting vehicle of this disclosure further comprises a load-carrying rod 55 fixed onto the bottom plate 14 of the base frame 10 and extended upwardly and protruded from the top of the front plate 11 and the top of the rear plate 12, wherein the load-carrying rod 55 is provided for coupling the lifting vehicle to a rail of a ceiling (not shown in the figure).

The healthcare lifting vehicle of this disclosure further comprises a control unit 60 electrically coupled to the drive mechanism 20 for controlling the operation or stopping the operation of the drive mechanism 20.

The healthcare lifting vehicle of this disclosure further comprises an overload protection unit 61, which may be an electronic scale, installed at a center position of the load-carrying rod 55, and the overload protection unit 61 is electrically coupled to the control unit 60 for detecting the weight of a load, and the control unit 60 sends the weight of the load to a display unit (not shown in the figure) for display. If the load exceeds a rated weight, the control unit 60 will send out an electrical signal to drive the drive mechanism 20 to stop its operation.

Figure 6:
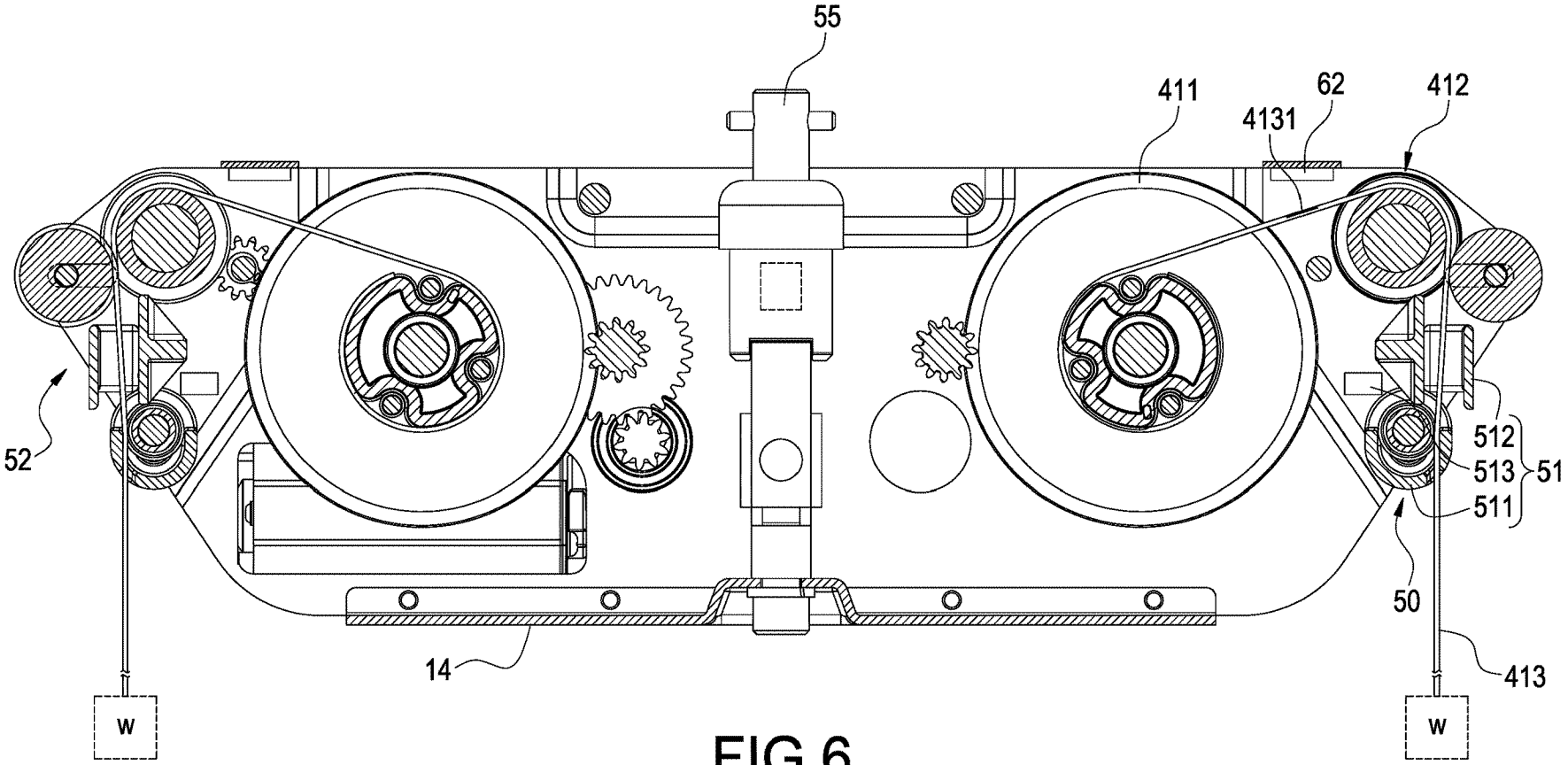
FIG. 6 is a second cross-sectional view showing a using status of the healthcare lifting vehicle of this disclosure.

The healthcare lifting vehicle of this disclosure further comprises a position sensing unit 62, and a color strip 4131 installed at a position near where the conveyor belt 413 is fixed to the reel 411 (as shown in FIG. 6), and the position sensing unit 62 is installed at the base frame 10, situated on a moving path of the conveyor belt 413, and electrically coupled to the control unit 60. If the position sensing unit 62 detects the color strip 4131, the position sensing unit 62 will send an electrical signal to the control unit 60, and the control unit 60 will send out an electrical signal to drive the drive mechanism 20 to stop its operation.

The healthcare lifting vehicle of this disclosure further comprises an emergency power supply unit 63 installed on a side of the front plate 11*a* of the base frame 10 and electrically coupled to the control unit 60. If a power failure occurs during the process of moving the conveyor belt 413, then the emergency power supply unit 63 will supply a primary electrical power to the drive mechanism 20 to descend the load W (as shown in FIG. 4) safely to a low position.

Figure 4:
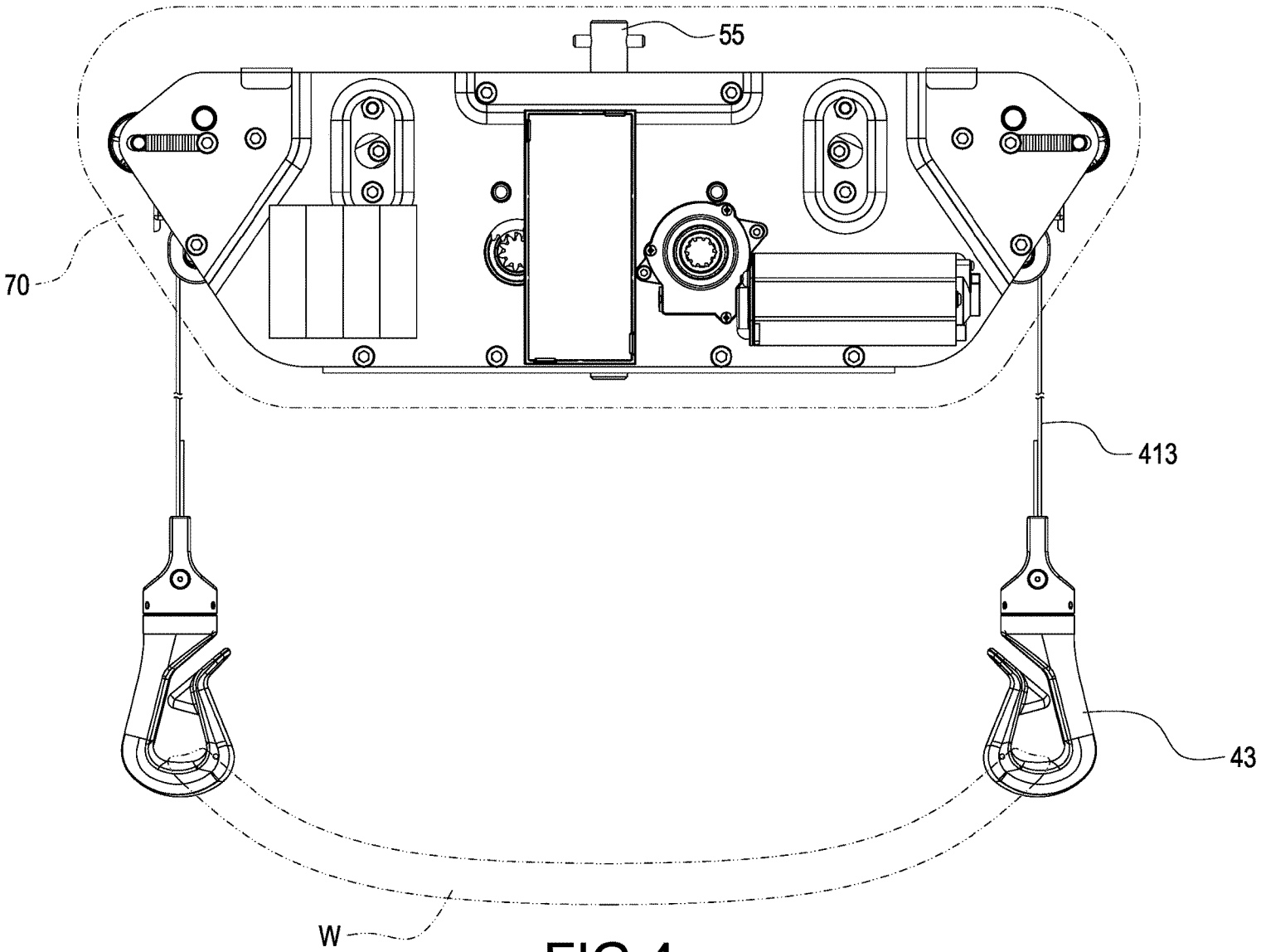
FIG. 4 is a side view of the healthcare lifting vehicle of this disclosure.

The healthcare lifting vehicle of this disclosure further comprises an enclosure 70 covering the exterior of the base frame 10, and each of the conveyor belt 413 and each of the hooks 43 are extended downwardly and passed out of the enclosure 70 (as shown in FIG. 4).

In the operation of aforementioned components, the first motor 21 and the second motor 22 of the drive mechanism 20 drive the first conveying mechanism 41 and the second conveying mechanism 42 of the conveying mechanism 40 by the reduction gear sets 23 respectively. After each reel 411 is driven to rotate clockwise, each of the conveyor belts 413 is released, and each idler gear 414 drives the driven wheel 4121 and the one-way rotary wheel 4122 of each transfer gear 412 to rotate, and the rotation of the one-way rotary wheel 4122 assists the conveyor belt 413 in the conveying process. During the ascending operation, each motor 21, 22 is rotated in a reverse direction, and after each reel 411 is driven to rotate counterclockwise, each of the conveyor belts 413 is rewound, and each idler gear 414 drives the driven wheel 4121 of each transfer gear 412 to rotate. Now, the one-way rotary wheel 4122 will not rotate, because it is separated from the driven wheel 4121.

In FIGS. 5 and 6, after the conveyor belt 413 carries a load W (as shown in FIG. 6) to move, the load W is acted by gravity, so that the conveyor belt 413 is drooped in a vertical direction. Now, each pressure wheel 311 is pushed by the conveyor belt 413 to move in a direction away from the transfer gear 412. On the other hand, when each conveyor belt 413 does not carry a load W to move (as shown in FIG. 5), each pressure wheel 311 is pulled by the elastic member 315, so that each pressure wheel 311 approaches in a direction towards the transfer gear 412, and operates together with the transfer gear 412 to clamp the conveyor belt 413 and maintain the conveyor belt 413 in a tight state.

Figure 8:
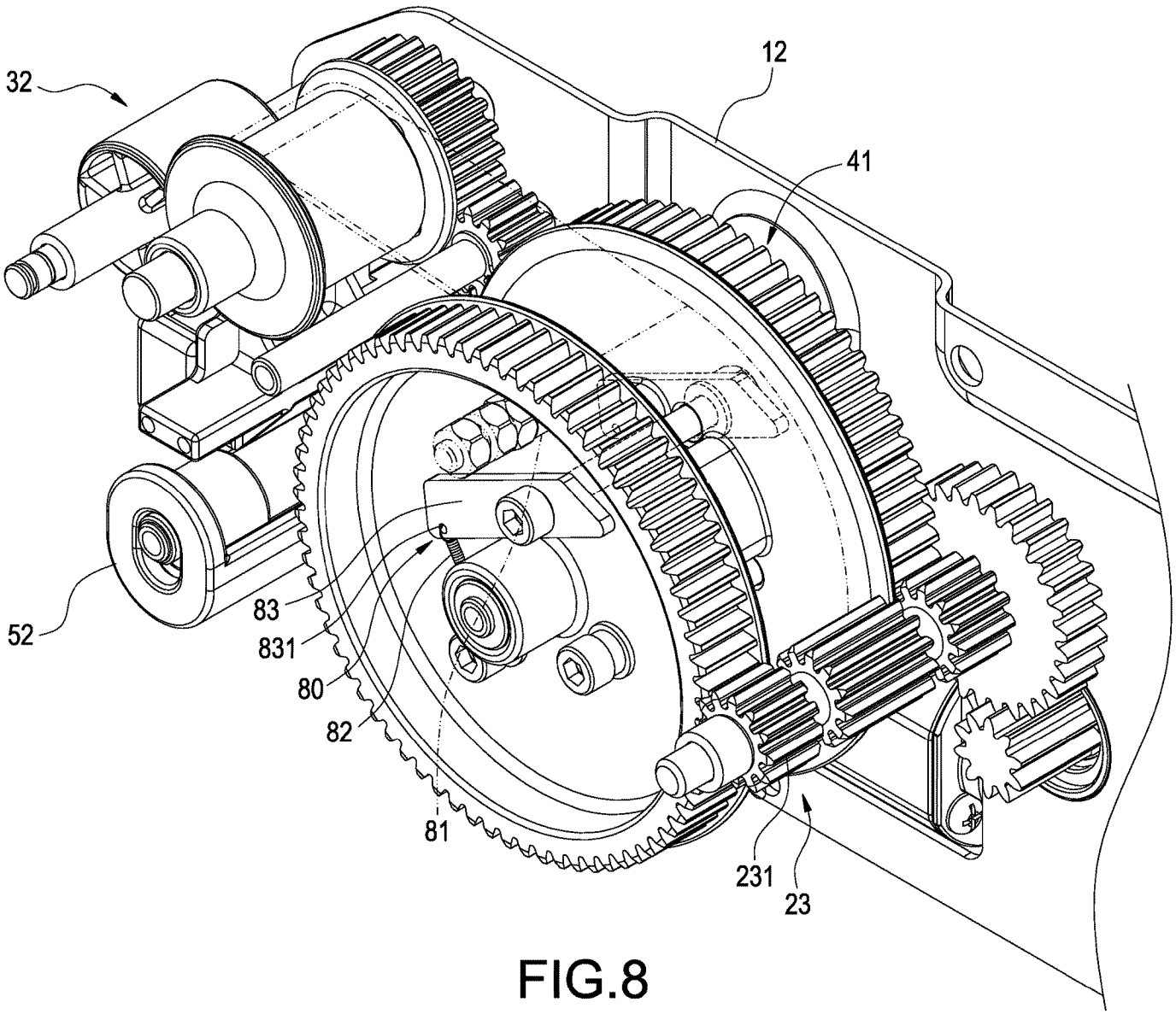
FIG. 8 is a perspective view of a brake mechanism combined with a reel in accordance with this disclosure.
Figure 9:
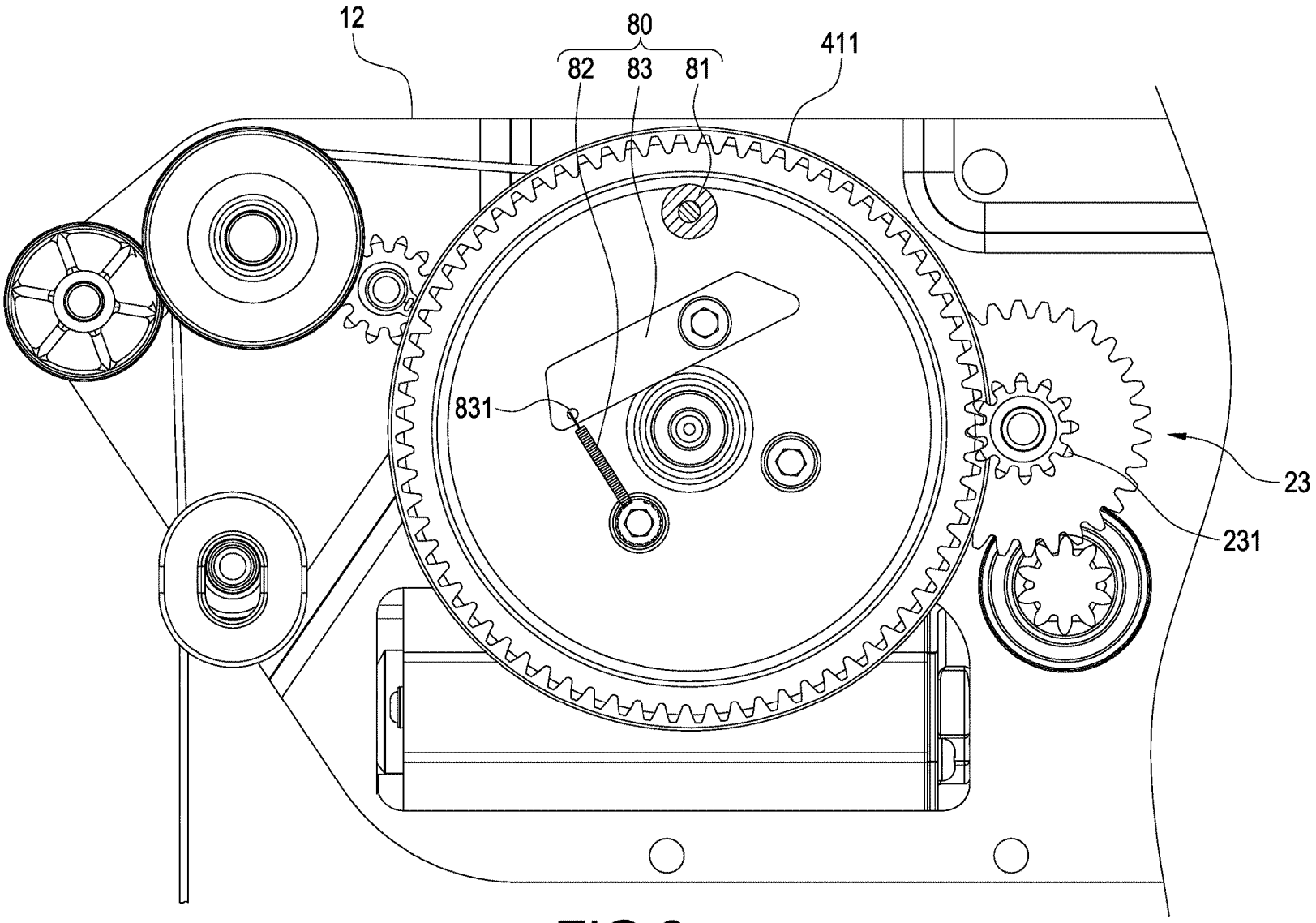
FIG. 9 is a front view of the brake mechanism of FIG. 8.
Figure 10:
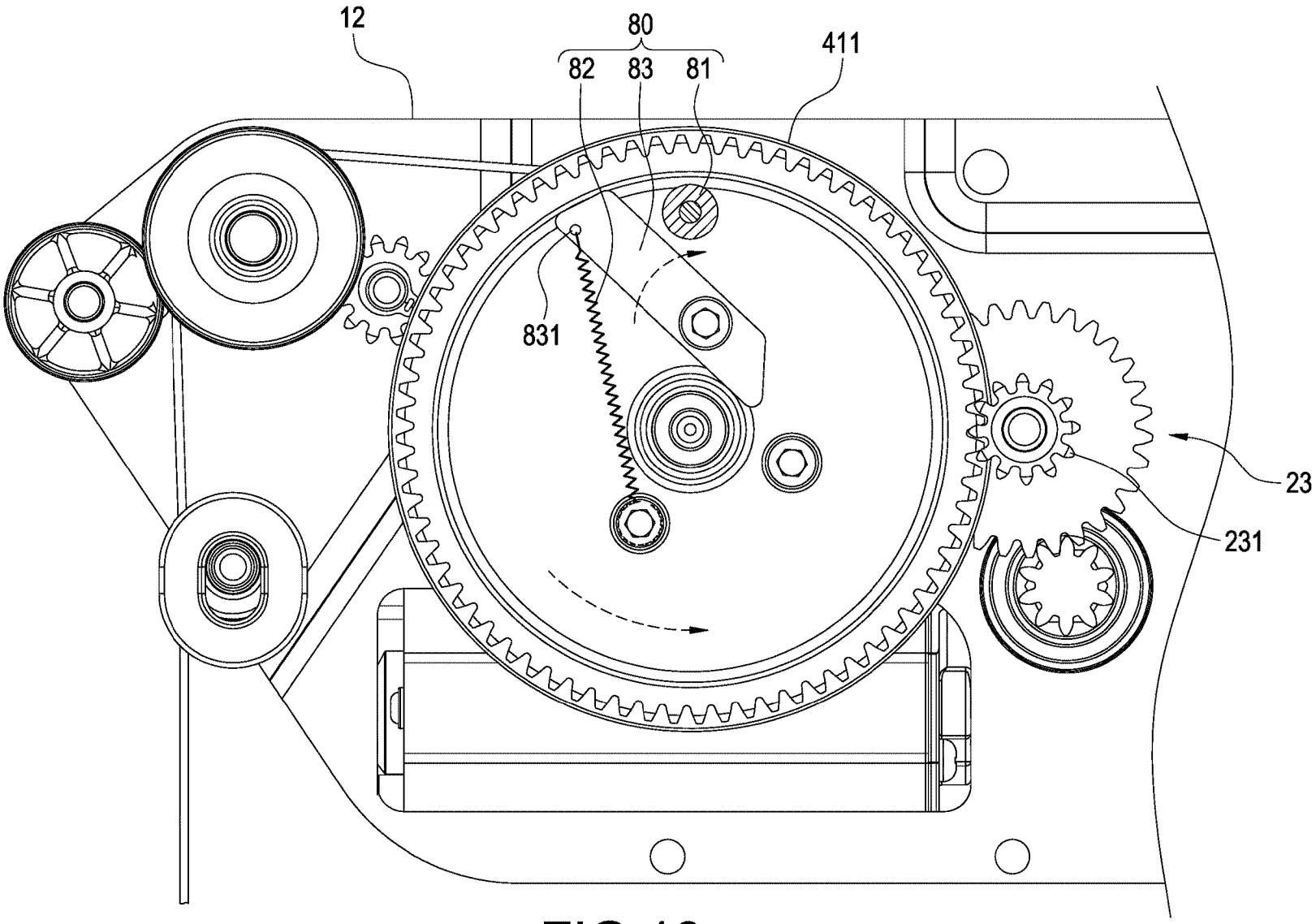
FIG. 10 is a schematic view showing a using status of the brake mechanism of FIG. 8.

In FIGS. 8 to 10, the healthcare lifting vehicle of this disclosure further comprises a brake mechanism 80, and the reduction gear set 23 further comprises a driving wheel 231 engaged with the reel 411 in addition a driven wheel engaged with the first motor 21, and the brake mechanism 80 is installed between the reel 411 and the base frame 10, and the brake mechanism 80 comprises an engaging column 81, a tension spring 82 and a brake pad 83, and the engaging column 81 is fixed to an inner side of the front plate 11 of the base frame 10 and at a fixed point that will not rotate with the reel 411. An end of the tension spring 82 is fixed to the reel 411. The brake pad 83 has an end pivotally coupled to the reel 411 by a bolt and the other end having a through hole 831 provided for coupling the other end of the tension spring 82.

Similarly, the brake mechanism 80 can be installed on the other side of the reel 411, wherein the engaging column 81 is fixed onto an inner side of the rear plate 12 of the base frame 10. Of course, the brake mechanism 80 can be installed separately on the front and rear sides of the reel 411 and between the front plate 11 and the rear plate 12.

Under normal conditions, the tension spring 82 is hooked into the through hole 831 of the brake pad 83, so that the brake pad 83 is maintained to abut against the axial position of the reel 411 and keep the reel 411 at a normal rotating state.

Without the installation of the brake mechanism 80, the engaging teeth of the reel 411 cannot be engaged with the driving wheel 23 of the reduction gear set 231 if a load W is hung and the teeth of the reel 411 are broken. Now, the weight of the load W will drive the reel 411 to produce a high-speed rotation (or have a stalling speed), and the conveyor belt 413 will be released quickly to cause the load W to fall with a gravitational acceleration.

With the installation of the brake mechanism 80, if the teeth of the reel 411 are broken and the reel 411 produces a high-speed rotation such that the centrifugal force of the rotation of the reel 411 is greater than the elastic pulling force of the tension spring 82, and the brake pad 83 cannot be hold by the tension spring 82 but thrown off to the outside (as shown in FIG. 10), then the brake pad 83 will rotate together with the reel 411 in a counterclockwise direction, until the brake pad 83 touches the engaging column 81, and then the reel 411 cannot be rotated anymore, so as to achieve the braking effect.

While this disclosure has been described by means of specific embodiments, numerous modifications and variations could be made thereto by those skilled in the art without departing from the scope and spirit of this disclosure set forth in the claims.

What is claimed is:

1. A healthcare lifting vehicle, for hanging a load, comprising:

a base frame;

a drive mechanism, fixed onto the base frame;

a preloading mechanism, comprising a pressure wheel and an elastic member, and the pressure wheel being movably coupled to the base frame, and the elastic member having a first end coupled to the pressure wheel; and a conveying mechanism, comprising a reel, a transfer gear and a conveyor belt, and the reel being pivotally coupled to the base frame and driven by the drive mechanism to rotate, and the transfer gear being axially coupled to the base frame and formed on a side of the pressure wheel, and the conveyor belt being wound around the reel and extending in a direction towards the transfer gear, and elastically clamped between the transfer gear and the pressure wheel; wherein when the conveyor belt carries the load to move, the pressure wheel is pushed by the conveyor belt in a direction away from the transfer gear, and when the conveyor belt does not carry the load to move, the pressure wheel is acted by the elastic member and operated with the transfer gear jointly to clamp the conveyor belt.

2. The healthcare lifting vehicle as claimed in claim 1, wherein the transfer gear comprises a driven wheel and a one-way rotary wheel detachably coupled to the driven wheel, and the reel drives the driven wheel through an idler gear, and the conveyor belt is wound around the one-way rotary wheel.

3. The healthcare lifting vehicle as claimed in claim 2, wherein the one-way rotary wheel is rotated with the driven wheel during a rotation process of the reel for releasing the conveyor belt, and the one-way rotary wheel is detached from a linkage with the driven wheel and not rotated during the rotation process of the reel for rewinding the conveyor belt.

4. The healthcare lifting vehicle as claimed in claim 1, wherein the base frame comprises a front plate and a rear plate disposed with an interval from the front plate, and the front plate and the rear plate have a strip groove each, and the strip grooves are configured to be corresponsive to each other, and the pressure wheel comprises a roller and a shaft extending from the center of the roller to both sides, and each of shafts is movably passed and coupled into each of the respective strip grooves.

5. The healthcare lifting vehicle as claimed in claim 1, further comprising a guide mechanism installed at the base frame and formed at a lower position of the transfer gear and the pressure wheel.

6. The healthcare lifting vehicle as claimed in claim 5, wherein the guide mechanism comprises a first guide assembly, and the first guide assembly comprises a belt guide seat, an overbelt member and a micro switch, and the belt guide seat is movably coupled to the base frame, and the overbelt member is mounted onto a top of the belt guide seat, and the micro switch is fixed to the base frame and formed on the top of the belt guide seat, and the conveyor belt is passed out from the belt guide seat and the overbelt member.

7. The healthcare lifting vehicle as claimed in claim 1, wherein the drive mechanism comprises a first motor and a second motor, and the conveying mechanism comprises a first conveying mechanism and a second conveying mechanism, and the first motor drives the first conveying mechanism through a reduction gear set, and the second motor drives the second conveying mechanism through another reduction gear set.

8. The healthcare lifting vehicle as claimed in claim 7, wherein the preloading mechanism comprises a first preloading mechanism and a second preloading mechanism, and the first preloading mechanism is configured to be corresponsive to the first conveying mechanism, and the second preloading mechanism is configured to be corresponsive to the second conveying mechanism.

9. The healthcare lifting vehicle as claimed in claim 1, further comprising a control unit electrically coupled to the drive mechanism.

10. The healthcare lifting vehicle as claimed in claim 9, further comprising a load-carrying rod and an overload protection unit, and the load-carrying rod being fixed onto the base frame, and the overload protection unit being installed at the load-carrying rod and electrically coupled to the control unit.

11. The healthcare lifting vehicle as claimed in claim 9, further comprising a position sensing unit, a color strip disposed near a position wherein the conveyor belt is fixed to the reel, and the position sensing unit being installed at the base frame, configured to be corresponsive to a moving path of the color strip, and electrically coupled to the control unit.

12. The healthcare lifting vehicle as claimed in claim 9, further comprising an emergency power supply unit installed at the base frame and electrically coupled to the control unit.

13. The healthcare lifting vehicle as claimed in claim 1, wherein the conveying mechanism further comprises a hook coupled to an end of the conveyor belt away from the reel.

14. The healthcare lifting vehicle as claimed in claim 1, wherein a second end of the elastic member is fixed to the base frame.

15. The healthcare lifting vehicle as claimed in claim 1, further comprising a brake mechanism installed between the reel and the base frame.

16. The healthcare lifting vehicle as claimed in claim 15, wherein the brake mechanism comprises an engaging column, a tension spring and a brake pad, and the base frame comprises a front plate, and the engaging column is fixed to the front plate, and both ends of the tension spring are fixed to the reel and an end of the brake pad, and the other end of the brake pad is pivotally coupled to the reel.

* * * * *